United States Patent [19]

Yampolsky et al.

[11] Patent Number: 4,577,682

[45] Date of Patent: Mar. 25, 1986

[54] HEAT EXCHANGER

[75] Inventors: Jack S. Yampolsky; David P. E. Carosella, Jr., both of San Diego, Calif.

[73] Assignee: GA Technologies Inc., San Diego, Calif.

[21] Appl. No.: 645,999

[22] Filed: Aug. 30, 1984

[51] Int. Cl.[4] ..... F28F 9/22

[52] U.S. Cl. ..... 165/160; 165/113; 165/114; 60/644.1

[58] Field of Search ..... 165/158, 160, 161, 111, 165/113, 114

[56] References Cited

U.S. PATENT DOCUMENTS

| | | | |
|---|---|---|---|
| 1,773,037 | 8/1930 | Forncrook . | |
| 2,018,037 | 10/1935 | Sieder | 257/239 |
| 2,132,093 | 10/1938 | Bennett | 257/225 |
| 2,399,484 | 4/1946 | Gunter | 257/221 |
| 2,492,409 | 12/1949 | Worn et al. | 257/221 |
| 3,156,296 | 11/1964 | Kelp | 165/74 |
| 3,187,807 | 6/1965 | Ammon | 165/158 |
| 3,289,756 | 12/1966 | Jaeger | 165/158 |
| 3,434,807 | 3/1969 | Ibing et al. | 23/288 |
| 3,526,275 | 9/1970 | Vance et al. | 165/158 |
| 3,712,370 | 1/1973 | Gilli et al. | 165/161 |
| 3,797,566 | 3/1974 | Credoz et al. | 165/160 |
| 4,093,022 | 6/1978 | Polyak, Jr. | 165/39 |
| 4,098,329 | 7/1978 | Culver | 165/158 |
| 4,106,560 | 8/1978 | Lauro | 165/159 |
| 4,163,470 | 8/1979 | Johnson et al. | 165/160 |
| 4,203,906 | 5/1980 | Takada et al. | 260/346.4 |

FOREIGN PATENT DOCUMENTS

| | | | |
|---|---|---|---|
| 601049 | 7/1934 | Fed. Rep. of Germany | 165/160 |

*Primary Examiner*—Albert W. Davis, Jr.
*Attorney, Agent, or Firm*—Fitch, Even, Tabin & Flannery

[57] ABSTRACT

Heat exchange apparatus comprises a generally cylindrical tank having an inlet port for entry of gas and an outlet port for exit of the gas after it is cooled, and an annular bundle of tubes disposed within the tank. The tank includes a cylindrical side wall or shell which encloses the tube bundle, and upper and lower annular manifolds for controlling flow through the tube interiors. The tank inlet port is located centrally of the upper annular manifold, and the tank outlet port is located on the shell. The annular tube bundle has a generally cylindrical interior having a longitudinal axis parallel to that of the shell. The interior of the annular tube bundle is aligned with the inlet port so that the interior of the tube bundle functions as an inlet plenum for the gas entering the recuperator. The annular tube bundle is radially offset from the center of the tank so that an eccentric outlet plenum is provided between the tube bundle and the shell for flow of gas circumferentially and axially of the shell toward the outlet port.

4 Claims, 3 Drawing Figures

HEAT EXCHANGER

BACKGROUND OF THE INVENTION

The present invention relates generally to heat exchange apparatus.

It is well known for a heat exchanger to enable flow of a first fluid over a plurality of finned tubes containing a second fluid so as to transfer heat from one fluid to the other. Heat exchangers of this type may be used, for example, in power generation systems. In any particular application, it is generally desirable that a heat exchanger be capable of transferring heat at a predetermined rate from one fluid to the other at particular fluid flow rates for each of the fluids without excessive resistance to fluid flow. It is also desirable that the heat exchanger not be overly large or overly expensive to build. It is well known that the rate at which heat may be exchanged between two fluids at particular temperatures and flow rates for the respective fluids may be increased by increasing the heat exchange area—i.e., the aggregate surface area of conductive material exposed to the respective fluids. However, increasing heat exchange area generally requires use of additional material, which increases the size and cost of the heat exchanger.

The present invention relates to a heat exchanger having a novel configuration which provides improved efficiency for a given heat transfer area.

SUMMARY OF THE INVENTION

The heat exchanger of the present invention comprises a generally cylindrical tank having an inlet port for entry of gas and an outlet port for exit of the gas after it has been cooled, and an annular bundle of tubes disposed within the tank. The tank includes a cylindrical side wall or shell which encloses the tube bundle, and upper and lower annular manifolds for controlling flow through the tube interiors. The tank inlet port is located centrally of the upper annular manifold, and the tank outlet port is located on the shell. The annular tube bundle has a generally cylindrical interior having a longitudinal axis parallel to that of the shell. The interior of the annular tube bundle is aligned with the inlet port so that the interior of the tube bundle functions as an inlet plenum for the entering gas. In accordance with the present invention, the annular tube bundle is radially offset from the center of the tank so that an eccentric outlet plenum is provided between the tube bundle and the shell for flow of gas circumferentially and axially of the shell toward the outlet port.

DETAILED DESCRIPTION OF A PREFERRED EMBODIMENT

Figure 1:
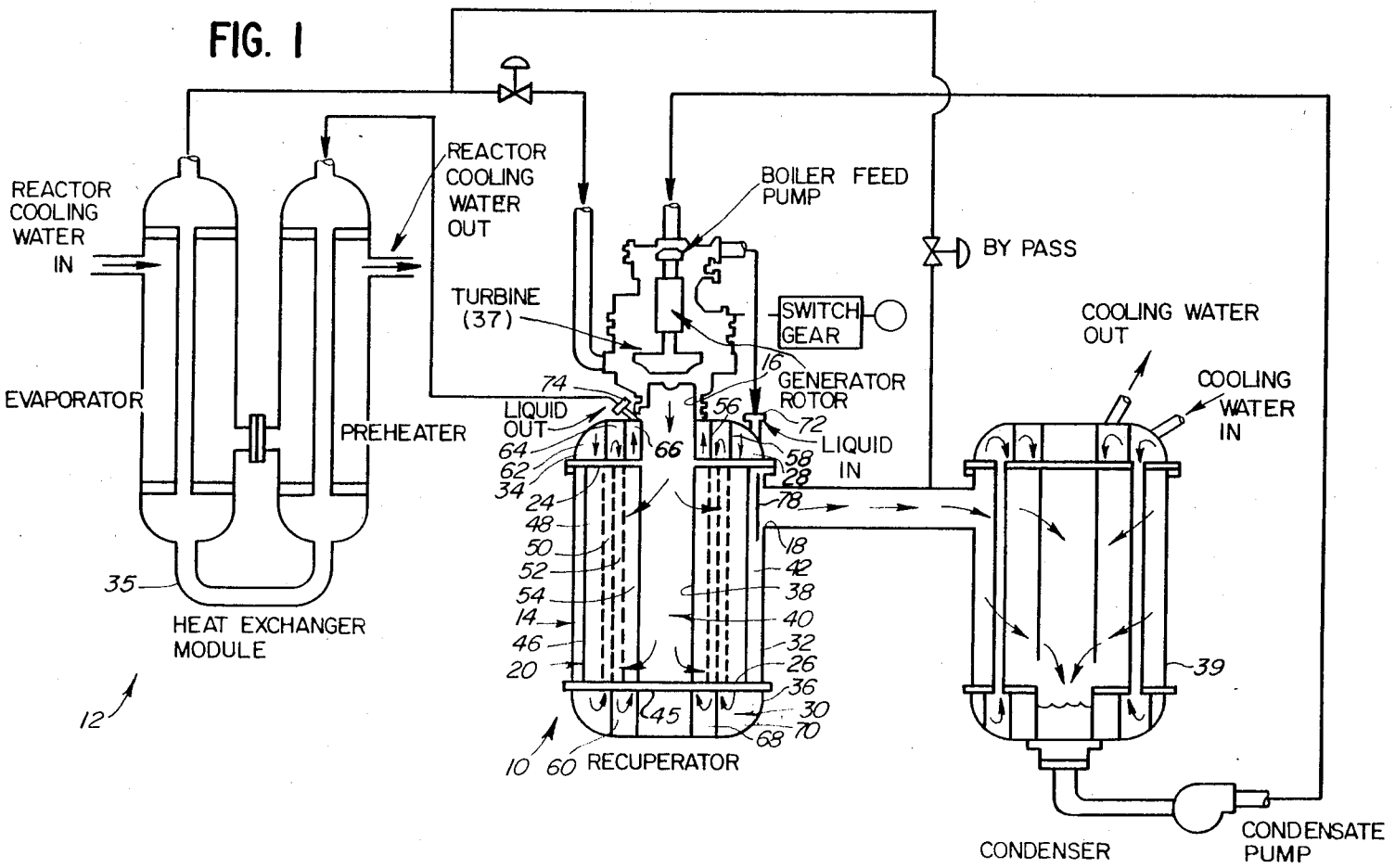
FIG. 1 is a diagrammatic view of a power generation system using a recuperator in accordance with the present invention.

In the illustrated embodiment, the present invention is embodied in a recuperator 10 for transferring heat from a gas to a liquid without change of phase. Herein, the recuperator is illustrated and described as part of a nuclear power generation system 12 (FIG. 1). It will be understood that the invention might alternatively be embodied in heat exchange apparatus for use in other environments, such as in gas turbine engines.

The recuperator 10 comprises a generally cylindrical tank 14 having an inlet port 16 for entry of gas and an outlet port 18 for exit of the gas after it is cooled, and an annular bundle 20 of tubes 22 disposed within the tank. The tubes extend through tube sheets 24 and 26 at their upper and lower ends. An upper manifold 28 encloses the upper ends of the tubes 22 and a lower manifold 30 encloses the lower ends of the tubes. The tank 14 includes a cylindrical side wall, or shell 32, which encloses the tube bundle 20, and upper and lower annular walls 34 and 36 which provide the outer walls of the respective manifolds 28 and 30.

The liquid flows through the interiors of the tubes 22 while the gas flows over the exteriors of the tubes 22. The interior of the recuperator may be referred to in terms of a "tube side", which includes the interiors of the tubes 22 and manifolds 28,30 for flow of liquid; and a "shell side" which includes the space outside of the tubes 22 within the shell 32.

The power generation system 12 illustrated in FIG. 1 includes a heat exchanger module 35 wherein the heated coolant from a nuclear reactor (not shown) is used to heat Freon (R-114) which is used to drive a turbine 37. The turbine 37 is located directly above the recuperator 10. The Freon evaporates in the heat exchanger module 35; expands through the turbine 37; flows downwardly into the shell side of the recuperator 10 where it is cooled; flows to a condenser 39 where it is further cooled to liquid phase; flows through the tube side of the recuperator 10 where it is heated by the Freon on the shell side emerging from the turbine 37; and flows from the recuperator 10 back to the heat exchanger module 35 to again be heated by the reactor coolant.

The annular tube bundle 20 has a generally cylindrical interior 38 having a longitudinal axis parallel to that of the generally cylindrical tank 14. The interior of the annular tube bundle 20 is aligned with the inlet port 16 so as to define an inlet plenum 40 for the gas entering the recuperator 10. During operation, the gas flows downwardly into the inlet plenum 40 and from there radially outwardly over the tubes 22 to an outlet plenum 42 defined between the tube bundle 20 and the shell 14. Once in the outlet plenum 42, it flows circumferentially and axially toward the gas outlet port 18.

The various tubes 22 in the annular tube bundle 20 are evenly distributed about the circumference of the bundle. If the tube bundle 20 were disposed centrally of the shell 32, the flow rate through the portion of the tube bundle 20 adjacent the outlet port 18 would be higher than the flow rate through the portion opposite the outlet port 18.

In accordance with the present invention, the annular tube bundle 20 is radially offset from the center of the tank 14 so that the outlet plenum 42 is eccentric—i.e., has a radial dimension which varies about the circumference of the tank 14. This configuration enables flow of Freon vapor to be relatively evenly distributed over the various individual tubes 22 in the annular tube bundle 20, and to flow circumferentially between the tube bundle 20 and the shell 32 with relatively little flow resistance, all with relatively little difference between the outer diameter of the tube bundle 20 and the inner diameter of the shell 32.

In the illustrated embodiment, the tubes 22 are disposed vertically and are constrained at their upper and lower ends by the upper and lower tube sheets 24 and 26. The inner diameter and outer diameter of the tube bundle 20 are represented by lines 44 and 46 respectively. The tube sheets 24 and 26 are perforated to accommodate the ends of the tubes 22, and the ends of the tubes 22 extend into the perforations. The tube sheets 24 and 26 are impermeable so as to prevent flow of gas longitudinally of the ends of the tubes 22 outside of the tubes.

Figure 3:
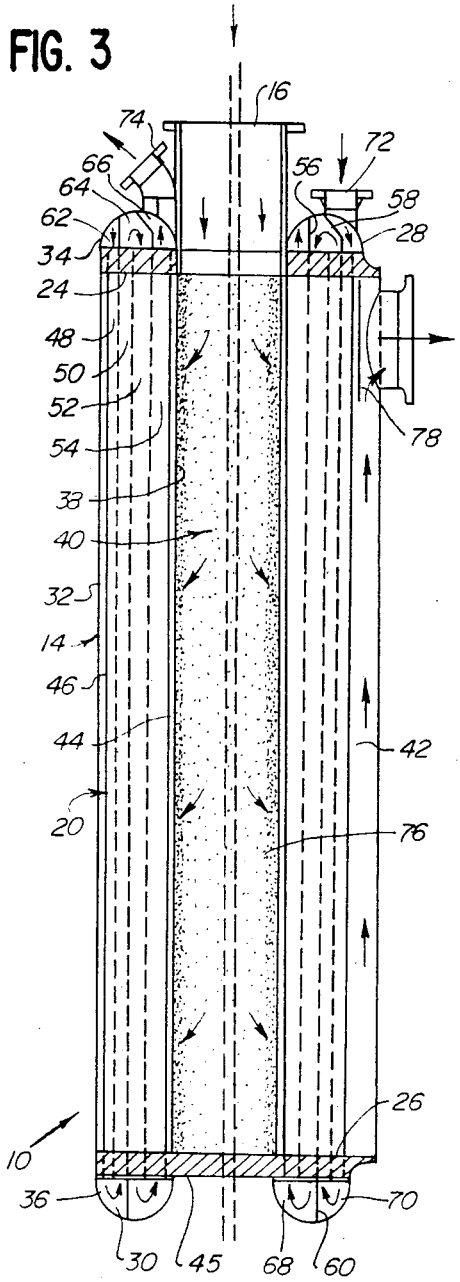
FIG. 3 is a partly diagrammatic sectional view taken along line 3—3 of FIG. 2 and looking in the direction of the arrows.

As shown in FIG. 3, the tube sheets 24, 26 are generally circular. The upper tube sheet 24 has an opening therein to define the inlet port 16. The central portion 45 of the lower tube sheet 26 provides a bottom wall for the inlet plenum 40.

In the illustrated embodiment, means are provided to direct flow of the liquid in four passes through the tubes 22, effectively dividing the tubes 22 into four annular coaxial groups 48, 50, 52 and 54. These groups 48, 50, 52 and 54 are indicated diagrammatically by vertical broken lines in FIGS. 1 and 3. The groups 48, 50, 52 and 54 are defined by inner and outer annular dividers 56 and 58 respectively which extend from the upper tube sheet 24 to the upper annular wall 34 of the upper manifold 28, and an annular divider 60 which extends from the lower tube sheet 26 to the lower annular wall 36. The upper dividers 56 and 58 define three coaxial annular spaces 62, 64 and 66 in the upper manifold 28 and two coaxial annular spaces 68 and 70 in the lower manifold 30.

The liquid Freon enters the recuperator 10 through an inlet port 72 and flows into the outermost annular space 62 in the upper manifold 28; flows downwardly therefrom through the outermost group 48 of tubes 22 to the outer space 70 in the lower manifold 30; flows back up through the second outermost group 50 of tubes 22 to the middle annular space 64 in the upper manifold 28; flows downwardly through the next group 52 of tubes 22 to the inner annular space 68 in the lower manifold 30; and flows back upward through the innermost group of tubes 54, through the innermost space 66 in the upper manifold 28, and out of the manifold 28 through an outlet port 74.

Each annular group of tubes 22 preferably includes an equal number of tubes so as to provide approximate uniformity of flow rate among all of the tubes 22. The tubes 22 are preferably finned to improved heat transfer between the two fluids. Other means for area extension of the tubes including spirally fluted or longitudinally fluted tubes could also be used. The tubes 22 shown in plan in FIG. 3 are illustrated disproportionately large for purposes of clarity.

The tube bundle 20 provides relatively high flow resistance to the gas on the shell side, which enables maintenance of relatively uniform pressure throughout the inlet plenum 40 so that flow is distributed relatively evenly along the length of the recuperator 10. To improve the uniformity of flow distribution along the length of the recuperator 10, an annular flow shroud 76 having a plurality of perforations therein extends along the interior of the annular tube bundle 20.

To further improve the uniformity of the flow distribution, an arcuate perforated baffle 78 is positioned along a portion of the outer diameter 46 of the annular tube bundle 20 adjacent the gas outlet port 18.

It will be appreciated that the above arrangement provides a counterflow effect in that the liquid flows generally inwardly toward the center of the recuperator 10 and the gas flows outwardly, away from the center. This enables the exit temperature of the liquid to be higher than the exit temperature of the gas.

Figure 2:
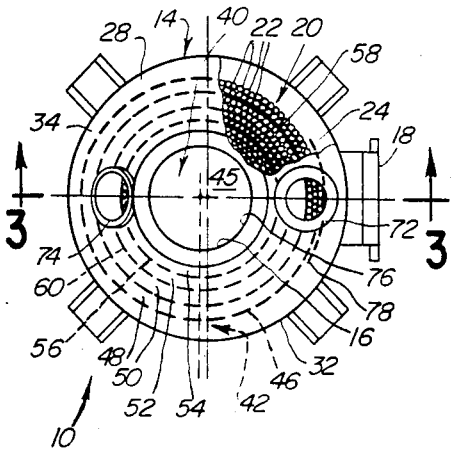
FIG. 2 is a plan view of a recuperator in accordance with the present invention shown with a portion broken away for clarity.

The recuperator 10 illustrated in FIGS. 2 and 3 may be disposed in a pit for use in a nuclear power generating system. To facilitate installation and maintenance, the inlet and outlet ports 16, 72, 18 and 74 are all located near the upper end so as to be accessible when the recuperator 10 is disposed within a pit. It will be appreciated that the recuperator 10 need not be disposed in an upright position, and that the invention is not limited to a recuperator having any particular orientation.

In the preferred embodiment of the present invention, the following performance parameters are maintained:

| | | |
|---|---|---|
| Vapor | | |
| Flow rate | | $2.56 \times 10^6$ lb/h |
| Inlet temperature/enthalpy | | 221° F./107.19 Btu/lb |
| Outlet temperature/enthalpy | | 120° F./88.46 Btu/lb |
| Inlet pressure | | 44.2 psia |
| Liquid | | |
| Flow rate | | $2.56 \times 10^6$ lb/h |
| Inlet temperature/enthalpy | | 102° F./32.27 Btu/lb |
| Outlet temperature/enthalpy | | 174° F./51.0 Btu/lb |
| Inlet pressure | | 702 psia |
| Heat duty | | $47.96 \times 10^6$ Btu/h |
| The above performance parameters are provided by a configuration as specified below: | | |
| Fin O.D. = 0.75 in. | | |
| Tube O.D. = 0.502 in. (root diam.) | | |
| 11 fins/in. | | |
| Fin thickness = 0.018 in. | | |
| Minimum wall thickness = 0.031 in. Fin height = 0.117 in. | | |
| Pitch = 0.90 in. | | |
| 7,688 tube lengths. | | |
| Shell I.D.: 104 in. | | |
| Tube Length (total): 29.0 ft | | |
| Effective length: 28.667 ft | | |
| Shell nozzle I.D.: | Outlet: | 36.0 in. |
| | Inlet: | 40.0 in. |
| Tube nozzle O.D.: | Outlet: | 12.1 in. |
| | Inlet: | 12.1 in. |
| Total effective heat transfer area: | | 115,925 $ft^2$ |
| Total installed heat transfer area: | | 116,428 $ft^2$ |
| Shell pressure drop: | | 2.5 psi |
| Tube pressure drop: | | 13.0 psi |
| Material: | | Aluminum |

In this particular embodiment, the annular tube bundle 20 is offset by 3 in. from the center of the shell 32, the shell has an inner diameter of 104 in., and the tube bundle 20 has a diameter of 93 in. Thus, the radial dimension of the gas outlet plenum 42 between the tube bundle 20 and the shell 32 varies from a minimum of 2.5 in. opposite the gas outlet port 18 to a maximum of 8.5 in. directly adjacent the gas outlet port.

From the foregoing, it will be appreciated that the present invention provides novel heat exchange apparatus. While a preferred embodiment is described above and illustrated in the accompanying drawings, there is no intent to limit the invention to this or any particular embodiment.

What is claimed is:

1. Heat exchange apparatus comprising:

a generally cylindrical tank defining a longitudinal axis and having an inlet port for entry of a first fluid and an outlet port for exit of said first fluid;

an annular tube bundle disposed within said tank, said annular tube bundle comprising a plurality of elongated metal tubes, said annular tube bundle defining a longitudinal axis substantially parallel to that of said tank and offset therefrom, and having a generally cylindrical interior communicating with said inlet port so as to define an axial inlet plenum for said first fluid;

means for effecting flow of said first fluid into said inlet plenum and thence outward through said tube bundle over said tubes; and means for effecting flow of a second fluid through the interiors of said tubes to effect heat transfer between said first fluid and said second fluid;

said outlet port being located on said tank substantially diametrically opposite said axis of said annular tube bundle whereby an asymmetrical outlet. Plenum is defined within said tank outside of said annular tube bundle.

2. Heat exchange apparatus in accordance with claim 1 further comprising a generally cylindrical, perforate flow distribution shroud extending coaxially within said annular tube bundle.

3. Heat exchange apparatus in accordance with claim 2 further comprising a baffle located adjacent said outlet port within said tank.

4. Heat exchange apparatus in accordance with claim 1 wherein each of said tubes has first and second open ends and said means for effecting flow of said second fluid through said tubes comprises a first manifold enclosing the first ends of said tubes a second manifold enclosing the second ends of said tubes, means for entry of said second fluid into said first manifold, means for discharge of said second fluid from said second manifold, and a plurality of generally circular dividers within the respective manifolds effectively separating said annular tube bundle into a plurality of annular coaxial groups and effecting flow of said second fluid in a plurality of passes, each pass being through one of said annular coaxial groups.

* * * * *

UNITED STATES PATENT AND TRADEMARK OFFICE

CERTIFICATE OF CORRECTION

PATENT NO. : 4,577,682

DATED : March 25, 1986

INVENTOR(S) : Yampolsky et al.

It is certified that error appears in the above-identified patent and that said Letters Patent is hereby corrected as shown below:

Column 5, Line 16: After "outlet" delete "." (period).

Column 5, Line 17: "Plenum" should read --plenum--.

Signed and Sealed this

*Twenty-ninth* Day of *July 1986*

[SEAL]

*Attest:*

DONALD J. QUIGG

*Attesting Officer*

*Commissioner of Patents and Trademarks*